US006619528B2

(12) United States Patent
Mochizuki

(10) Patent No.: US 6,619,528 B2
(45) Date of Patent: Sep. 16, 2003

(54) CARTRIDGE FOR HOUSING STAPLES

(75) Inventor: Naoto Mochizuki, Kofu (JP)

(73) Assignees: Acco Brands, Inc., Lincolnshire, IL (US); Nisca Corporation, Yamanashi-Ken (JP)

( * ) Notice: Subject to any disclaimer, the term of this patent is extended or adjusted under 35 U.S.C. 154(b) by 78 days.

(21) Appl. No.: 09/873,269

(22) Filed: Jun. 5, 2001

(65) Prior Publication Data

US 2002/0030078 A1 Mar. 14, 2002

(30) Foreign Application Priority Data

Jun. 5, 2000 (JP) ..... 2000-167135

(51) Int. Cl.[7] ..... B27F 7/38
(52) U.S. Cl. ..... 227/120; 227/139
(58) Field of Search ..... 227/131, 139, 227/120, 127

(56) References Cited

U.S. PATENT DOCUMENTS

| | | | | |
|---|---|---|---|---|
| 5,076,483 A | | 12/1991 | Olesen | 227/131 |
| 5,121,868 A | * | 6/1992 | Jairam | 227/123 |
| 5,230,457 A | | 7/1993 | Hiroi et al. | 227/2 |
| 5,460,314 A | | 10/1995 | Udagawa | 227/155 |
| 5,474,222 A | | 12/1995 | Kanai et al. | 227/131 |
| 5,580,066 A | * | 12/1996 | Jairam | 227/123 |
| 5,660,314 A | | 8/1997 | Magnusson et al. | 227/2 |
| 5,791,548 A | | 8/1998 | Udagawa et al. | 227/131 |
| 5,836,502 A | * | 11/1998 | Kanai et al. | 227/131 |
| 5,975,396 A | * | 11/1999 | Manabe | 227/2 |
| 6,039,230 A | * | 3/2000 | Yagi et al. | 227/120 |
| 6,135,337 A | | 10/2000 | Harris et al. | 227/131 |
| 6,371,351 B1 | | 4/2002 | Magnusson | |

FOREIGN PATENT DOCUMENTS

| | | |
|---|---|---|
| JP | 10-000578 | 1/1998 |
| JP | 2000-167782 | 6/2000 |

* cited by examiner

*Primary Examiner*—Rinaldi I. Rada
*Assistant Examiner*—Tara Ho
(74) *Attorney, Agent, or Firm*—Michael Best & Friedrich LLP

(57) ABSTRACT

A cartridge is provided that reliably feeds staples even when the sheet of staples is completely unraveled. A shaft is established in the housing unit for the cartridge as a mechanism for forming a space. The shaft is not centered inside the round housing unit but is instead off-center. In other words, the shaft is located beneath the center line of the housing unit. Also, the shaft is located completely inside the hollow cavity formed by the rolled sheet of staples. As a result, the sheet of staples does not come into contact with the interior walls of the housing unit even when the rolled sheet of staples is unraveled.

2 Claims, 7 Drawing Sheets

CARTRIDGE FOR HOUSING STAPLES

TECHNICAL FIELD

The present invention relates to a cartridge for housing staples used to supply staples from a rolled sheet of staples to the sorter or finisher inside an image forming device such as a photocopier or printer.

BACKGROUND

The following is an explanation of the stapling operation of a prior art stapler with reference FIG. 1 through FIG. 5. FIG. 1 is a simplified drawing of a stapler of the prior art. The main body of the stapler consists of a frame G. A mounting unit 2 and a drive mechanism 4 are installed in the frame G.

A stapling unit 14 is attached to the mounting unit 2 with an installed cartridge 9. A stack of paper (s) is placed under the stapling unit 14 and a staple 1 is driven through the stack of paper by the stapling unit 14.

The stapling unit 14 is moved up and down by the drive mechanism 4, and drives staples through stacks of paper (s).

The following is an explanation of the staples 1 and the cartridge 9 housing the staples with reference to FIG. 2. The staples 1 used to staple documents are stored in a continuous sheet of staples (a). In other words, the staples 1 are fused together in a consecutive sheet of staples (a). The staples 1 are applied one by one to documents, where they are bent into an angular C-shape and detached from the sheet of staples (a).

The sheet of staples (a) is wound in a roll and housed inside a cartridge 9. The cartridge 9 is equipped with a housing unit 10 for housing the rolled sheet of staples (a) and a guide unit 11 for guiding the end of the rolled sheet of staples (a) from the cartridge 9. The housing unit 10 has an outer diameter that conforms to the rolled sheet of staples (a) and a round inner periphery.

The guide unit 11 for guiding the sheet of staples (a) is equipped with a pair of walls 11*a*, 11*a* held apart at a given interval, and a protrusion 11*b*moving horizontally between the walls 11*a*, 11*a*. The protrusion 11*b* has a reverse motion stopping tab 12. The reverse motion stopping tab 12 has a tip that makes contact with the sheet of staples (a) advancing from the guide unit 11.

Guide grooves 11*c*, 11*c* are formed on the inside surface of the walls 11*a*, 11*a*. The guide grooves 11*c*, 11*c* support the sheet of staples (a). The interval between the guide grooves 11*a*, 11*a* has an angular C-shape and is roughly the length of a staple 1.

A guide tab 11*c* is located in the inner surface of the walls 11*a*, 11*a*, and this guide tab 11*c* prevents the sheet of staples (a) from rising off the base 11*h* of the guide unit 11.

The walls 11*a*, 11*a* are also equipped with tip contacting units 13, 13 for making contact with the main body of the device when the cartridge 9 is in the device. A catch 11*g* is situated on the base 11*h* of the guide unit 11 for keeping the cartridge 9 in a certain position inside the main body of the device.

What follows is a detailed explanation of a cartridge 9 installed in the mounting unit 2 with reference to FIG. 3. The mounting unit 2 is attached to the frame G above the base 3. The mounting unit 2 is attached to the shaft 8 on the frame G so as to be able to rotate freely.

When the cartridge 9 is installed in the mounting unit 2, the catch 11*g* on the cartridge 9 is drawn into the lock unit

15 formed in the mounting unit 2. The lock unit 15 is situated on the bottom of the mounting unit 2 and has a handle unit 15*a*, an elastic U-shaped unit 15*b* formed on the tip of the handle unit 15*a*, and a protrusion 15*c* protruding towards the bottom of the mounting unit 2 from the handle unit 15*a*. The tip U-shaped unit 15*b* is hung around the pin 16 on the base 3.

When the cartridge 9 is installed in a mounting unit 2 with a lock unit 15, the catch 11*g* on the cartridge 9 applies pressure to the protrusion 15*c* protruding towards the bottom of the mounting unit 2, and surmounts the protrusion 15*c*. Having surmounted the protrusion 15*c*, the cartridge 9 cannot be released because the catch 7 engages the protrusion 15*c*. In other words, the cartridge 9 cannot be extracted from the mounting unit 2 because of the lock unit 15.

When the cartridge 9 is removed from the mounting unit 2, the handle unit 15*a* is pressed down manually. When the handle unit 15*a* is pressed down, the end of the U-shaped unit 15*b* is pressed into the pin 16 and the U-shaped unit 15*b* is bent. The protrusion 15*c* is then released by the catch 11*g*. In other words, the handle unit 15*a* is pressed down and the cartridge 9 is removed from the mounting unit 2.

Also, when the cartridge 9 is installed in the mounting unit 2, the end comes into contact with the stapling unit 14. Here, the stapling unit 14 consists of a sheath bracket 17, a former 18 and a driver 19.

FIG. 4 is a detailed drawing of the stapling unit 14. A depression 18*a* is formed in the bottom the former 18, and a protrusion 18*b* is formed in the top of the former 18. This forms shoulders 18*c*, 18*c* on both ends.

The driver 19 has a bottom end that is divided into three plates with a long plate 19*a* in the middle and short plates 19*b*, 19*b* on the ends. A protrusion 20 is formed in the middle plate 19*a*, and this protrusion 20 makes contact with the former 18 on the opposite end.

The end of the middle plate 19*a* protrudes into the depression 18*a* in the former 18. The plates 19*b*, 19*b* on the ends are bent into a wedge shape, and the ends come into contact with the shoulders 18*c*, 18*c* on the former 18.

A bending block 21 is situated in the depression 18*a* of the former 18 and engages it. The bending block 21 has sloping sections 21*b*, 21*b* on both ends of the protrusion 21*a* and the protrusion 21*a* engages the depression 18*a* in the former 18.

As shown in FIG. 3, the bending block 21 is attached to the bottom of the mounting unit 2 via a spring 22, which applies spring action to the left in the drawing. Push units 18*d*, 18*d* are established in the former 18 to make contact with the sloping units 21*b*, 21*b* in the bending block 21. When the push units 18*d*, 18*d* make contact with the sloping units 21*b*, 21*b*, the spring 22 is coiled and the entire bending block 21 moves to the right in the drawing.

The top end of the driver 19 is fixed to the shaft 23, and the shaft 23 is connected so the drive mechanism 4 can move it up and down as shown in FIG. 5.

The front block 24 is attached to the shaft 23, and the front block 24 is supported by the spring shaft 25 protruding from the mounting unit 2 so that it can slide. A spring 26 is placed on the spring shaft 25 so as to apply pressure to the mounting unit 2 and the front block 24.

The mounting unit 2 is attached to the shaft 8 so it can rotate freely around the center. When the shaft 23 is raised, the front block 24 is also raised. When the shaft 23 is lowered, the mounting unit 2 is also lowered.

Therefore, when the front block 24 moves down, the mounting unit 2 moves down along the front block without compressing the spring 26 until the mounting unit 2 makes contact with the base 3. However, after the mounting unit 2 makes contact with the base 3, the spring 26 is compressed and the spring shaft 25 slides as the front block 24 moves down.

The raising and lowering of the stapling unit 14 and the mounting unit 2 by the drive mechanism 4 will now be explained in detail with reference to FIG. 5.

The drive mechanism 4 is powered by a motor 27, and the motor 27 is attached beneath the frame G. A long hole 5 is formed upward in the frame G, and a shaft 6 passes through the long hole 5. The shaft 6 passing through the long hole 5 is pressed downward by a spring 7 as shown in the drawing.

The motor 27 attached beneath the frame G has a shaft that protrudes outward from the frame G and the protruding end of the shaft has an attached pinion 28.

The pinion 28 engages a relay gear 29. The relay gear 29 is equipped with a first intermediary gear 30 having a diameter smaller than the relay gear. These two gears rotate concentrically. The relay gear 31 engages the first intermediary gear 30.

The relay gear 31 is equipped with a second intermediary gear 32 having a diameter smaller than the relay gear. These two gears also rotate concentrically. A drive gear 33 engages the second intermediate gear 32.

A pin 34 is located in the side of the drive gear 33. The pin 34 is inserted into the cam ring hole 35*a* in the cam ring 35. The cam ring 35 is supported by the shaft 6 attached to the frame G so as to be able to freely rotate. The shaft 6 is interposed, and an interposed support unit 35*b* is formed on the opposite side of the cam ring hole 35*a* to support the interposition of shaft 23.

The drive mechanism 4 has the same configuration on the other side of the frame G (not shown). In the drive mechanism 4, the rotation of the drive gear 33 rotates the pin 34 and shaft 6 moves the cam ring 35 up and down along the center line. In other words, the rotation of the pin 34 moves the cam ring hole 35*a* in the cam ring 35 upwards. The shaft 6 is interposed and the interposed support unit 35*b* on the opposite end is lowered. When the cam ring hole 35*a* is lowered, the interposed support unit 35*b*is raised.

A concentrically rotating cam 36 is situated on the drive gear 33, and the cam 36 presses the position detector 37*a* on the home position switch 37 on the frame G. When the stapling operation begins, the former 18 and driver 19 are in the initial position and the stapling operation is initiated if the cam 36 is making contact with the position detector 37*a* on the home position switch 37. If the cam 36 is not making contact with the position detector 37*a*, the motor 27 continues to rotate until contact is made. When the cam 36 makes contact with the position detector 37*a*, the stapling operation is initiated.

If the interposed support unit 35*b* is at the highest point when the cam 36 makes contact with the position detector 37*a*, the shaft 23 has also moved to the highest point.

The following is a detailed explanation of the feed mechanism for the sheet of staples (a) with reference to FIG. 3. The stapler performing the stapling operation described above has a feed mechanism to advance the staples. The feed mechanism is at the end of the mounting unit and consists of an advancing unit 39, a plate spring 40 and an advancing tab 42.

When a cartridge 9 is installed in the mounting unit 2, the protrusion 11*b* on the cartridge 9 makes contact with one end of the plate spring 40. The other end of the plate spring 40 makes contact with the advancing unit 39.

The advancing unit 39 is mounted on a shaft 41 connected to the mounting unit 2 so as to freely rotate. An advancing tab 42 is attached to the bottom. The end of the advancing tab 42 makes contact with the sheet of staples (a) drawn by the guide unit 11 from the cartridge 9, and the advancing tab 42 is positioned at a shallow angle with respect to the sheet of staples (a) moving in the forward direction.

A protrusion 39*a* is formed in the advancing unit 39. The protrusion 39*a* is positioned just beneath the driver 19 when the cartridge 9 is installed.

When the driver 19 is lowered, the protrusion 20 on the driver 19 makes contact with the protrusion 39*a* on the advancing unit 39. This applies pressure rightward in the drawing. Under pressure, the advancing unit 39 moves to the right while bending the plate spring 40. When the advancing unit 39 moves to the right, the advancing tab 42 also moves to the right over the sheet of staples (a). The amount of movement is equal to the width of a single staple.

When a staple 1 has been applied to a stack of paper (s) and the driver 19 is raised, the pressure on the protrusion 39*a* in the advancing unit 39 is released, and the plate spring 40 returns to its original shape.

When the plate spring 40 returns to its original shape, the advancing tab 42 which had moved to the right in the drawing then moves to the left. When the advancing tab 42 returns to its original position on the left, the tip of the advancing tab 42 engages a staple 1. As the advancing tab 42 moves to the left, the staple also moves to the left.

In other words, the movement from the right to the left by the advancing tab 42 extracts a single staple from the housing unit 10 in the cartridge 9. At this time, the sheet of staples (a) slides through the inner wall 10*a* of the housing unit 10, and the sheet of staples (a) in the housing unit 10 is fed into the guide unit 11 one staple at a time. The staple at the end of the guide unit 11 on the cartridge 9 is then moved to the stapling unit 14. The staple 1 is advanced to the stapling unit 14 as the stack of paper (s) is being stapled.

What follows is an explanation of the operation of the stapler. In a stapler with the configuration shown in FIG. 5, a stack of paper (s) is placed on the base 3, and a cartridge 9 is installed in the mounting unit 2. At this time, the bending block 21 is positioned above the stack of paper (s). A staple 1 is positioned above the stack, and the former 18 and driver 19 are positioned above the staple.

Here, the cartridge 9 is installed in the mounting unit 2 and the drive mechanism 4 is operated. When the motor 27 for the drive mechanism 4 is operated, the home position switch 37 and cam 36 are positioned above the shaft 23 in the initial position. The drive mechanism 4 is then operated to lower the shaft 23 from the initial position.

When the drive mechanism 4 is operated, the gears engage and rotate. Finally, the drive gear 33 is rotated. When the drive gear 33 rotates, the pin 34 also rotates. The rotation of the pin 34 rotates the cam ring 35 around the shaft 6 and lowers the interposed support unit 35*b*. When the interposed support unit 35*b* is lowered, the shaft 23 it supports is also lowered.

When the shaft 23 is lowered, the driver 19 it supports is lowered. When the driver 19 is lowered as shown in FIG. 4, the plates 19*b*, 19*b* on both ends press down on the shoulders 18*c*, 18*c* of the former 18, and the entire former 18 is pressed down. The long plate 19*a* in the driver 19 is inserted into the depression 18*a* of the former 18.

The lowering of the shaft 23 also lowers the front block 24. The front block 24 lowers the mounting unit 2 via the spring 7. The mounting unit 2 is lowered while maintaining a set distance from the front block 24 and not compressing the spring 7 until the bottom makes contact with the base 11.

When the cam ring 35 is rotated and the shaft 23 is lowered, the bending block 21 engages the depression 18*a* in the former 18.

Here, the staple 1 at the end of the sheet of staples (a) is positioned between the former 18 and the bending block 21. Therefore, when the depression 18*a* in the former 18 engages the bending block 21, the staple 1 is interposed between them. The staple 1 interposed between the former 18 and the bending block 21 is then bent into an angular C-shape by the depression 18*a* in the former 18.

When the cam ring 35 is rotated and the shaft 23 is lowered, the mounting unit 2 is also lowered and the mounting unit 2 is brought into contact with the base 3. Even when the mounting unit 2 is brought into contact with the base 3, the cam ring 35 is rotated and the shaft 23 lowered. The shaft 23 is lowered as the spring 26 is compressed by the front block 24.

When the shaft 23 is lowered as the spring 26 is compressed, the driver 19 is also lowered and the former 18 is pressed downward. When the former 18 is lowered, the push units 18*d* on both ends of the former 18 make contact with the sloping sections 21*a* on the bending block 21. When the push units 18*d* make contact with the sloping sections 21*a*, the former 18 compresses the spring 22 pressed against the bending block 21, and the bending block 21 is pushed to the right in the drawing. The pushed bending block 21 then retreats from beneath the angular C-shaped staple 1.

When the cam ring 35 is rotated, the driver 19 drives both ends of the angular C-shaped staple 1 through the stack of paper (s), and the staple 1 is detached from the sheet of staples (a).

The stack of paper (s) on the base 2 then forms a document 38, and the document 38 is stapled together by pushing the ends of the bent staple 1 through the sheets of paper. After the bent staple 1 has been pushed through the stack of paper (s), the ends of the staple 1 are folded inward. Once the staple 1 has been pushed through the stack of paper (s) and the ends have been folded inward, the stack of paper (s) is stapled.

When the cam ring 35 is rotated, the shaft 23 gradually rises. The shaft 23 rises to the top position and returns to its original position. A single rotation of the cam ring 35, in other words, brings the stapling operation to an end.

In the stapling operation, a staple is pushed through a stack of paper (s) as the feed mechanism feeds the device the next staple 1 to be applied. The next staple is positioned in the stapling unit 14 of the mounting unit 2.

The staple feed mechanism sends staples 1 one by one to the stapling unit 14. However, the feed mechanism rotates the rolled sheet of staples inside the housing unit 10 as the staples 1 are issued. As the rolled sheet of staples rotates, it expands.

Also, when a staple 1 becomes jammed, the cartridge 9 has to be removed. When the cartridge 9 is removed, the cartridge 9 is shaken. When the cartridge 9 is shaken, the rolled sheet of staples (a) moves up and down and left and right inside the cartridge 9.

When the rolled sheet of staples (a) moves inside the cartridge 9, the edge of the roll collides with the inside wall 10*a* of the housing unit 10 in the cartridge 9, and the impact expands the rolled sheet of staples (a).

When the rolled sheet of staples (a) expands, it expands concentrically. The rolled sheet of staples (a) expands but maintains a round shape.

When the rolled sheet of staples (a) expands, the sheet of staples (a) comes into contact with the inner wall 10*a* of the housing unit 10 of the cartridge 9. Because the inner wall 10*a* of the housing unit is round, the outer edge of the expanded rolled sheet of staples (a) comes into contact with the inner wall 10*a*. When the outer edge of the expanded rolled sheet of staples (a) comes into contact with the inner wall 10*a*, the contact area is increased. When the contact area between the sheet of staples (a) and the inner wall 10*a* is increased, the amount of friction between the sheet of staples (a) and the inner wall 10*a* also increases.

The unraveled sheet of staples (a) also exerts pressure. The sheet of staples (a), in other words, applies pressure on the inner wall 10*a*. The pressure on the inner wall increases the amount of friction further. When the amount of friction between the sheet of staples (a) and the inner wall 10*a* is increased, the sheet of staples (a) has difficulty sliding along the inner wall 10*a*.

The force used by the feed mechanism to feed the sheet of staples (a) largely depends on the feeding conditions. When the amount of friction between the sheet of staples (a) and the inner wall 10*a* is increased, the feed mechanism may have difficulty supplying the sheet of staples (a) and a feeding error could occur.

Therefore, there remains a need for an invention that reliably feeds staples even when the sheet of staples (a) is completely unraveled.

SUMMARY OF THE INVENTION

One embodiment of the invention relates to a cartridge for housing staples having a housing unit for housing a rolled sheet of staples and a guide unit for supporting the sheet of staples drawn from the housing unit, where the cartridge for housing staples is equipped with a space forming mechanism for forming a space between the rolled sheet of staples housed in the housing unit and the interior walls of the housing unit. The rolled sheet of staples may supported along a short axis of the housing unit.

Another embodiment relates to a cartridge for housing staples, where the rolled sheet of staples forms a hollow cavity centered on the roll and the space forming mechanism has a shaft off-center from the center line of the housing unit, and the shaft supports the hollow cavity of the rolled sheet of staples. The shaft may be off-center to a degree about the distance between a bottom of the inner wall of the housing unit and the shaft. Also the shaft may be off-center beneath a center line of the housing unit.

In the cartridge for housing staples of another embodiment, the space forming mechanism is a protrusion on the interior walls of the housing unit, and the rolled sheet of staples comes into contact with the protrusion.

In the cartridge for housing staples of yet another embodiment, the space forming mechanism is an oval shaped, triangular shape or rectangular shaped inner diameter of the housing unit.

DETAILED DESCRIPTION OF THE PREFERRED EMBODIMENTS

Figure 1:
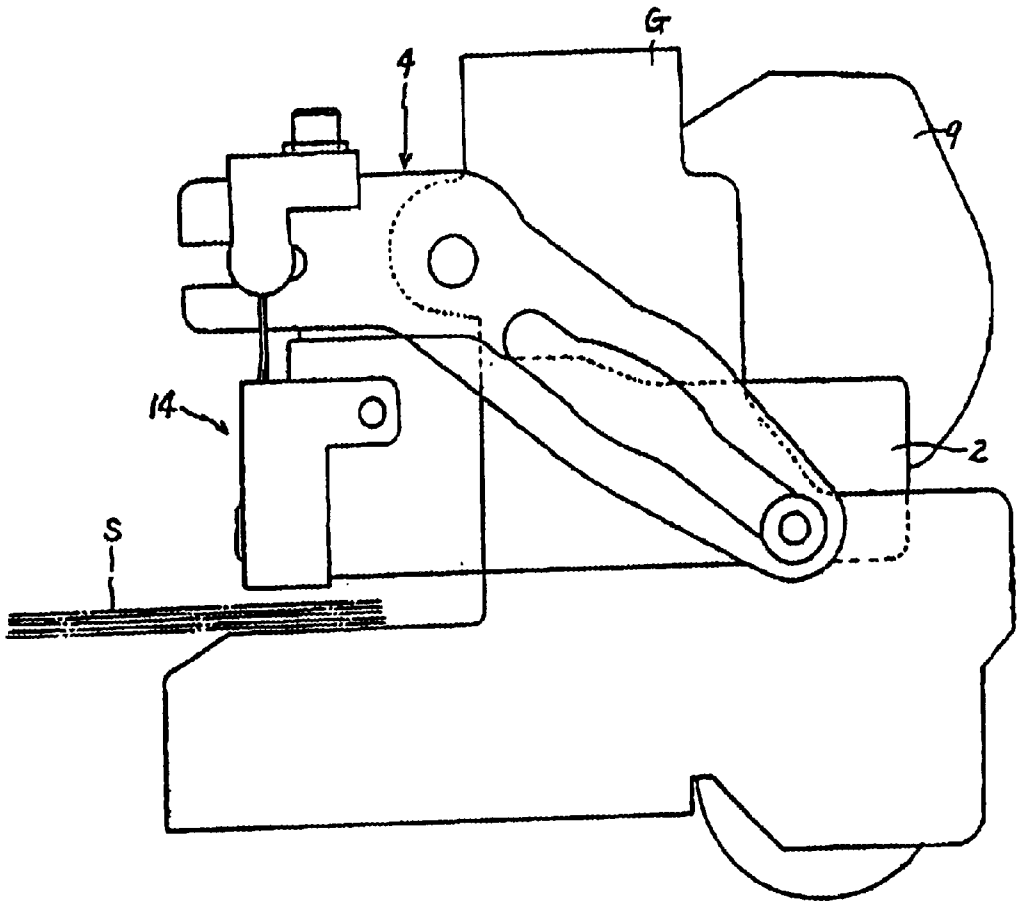
Fig. 1 PRIOR ART
FIG. 1 is a simplified drawing of a stapler of the prior art.
Figure 2:
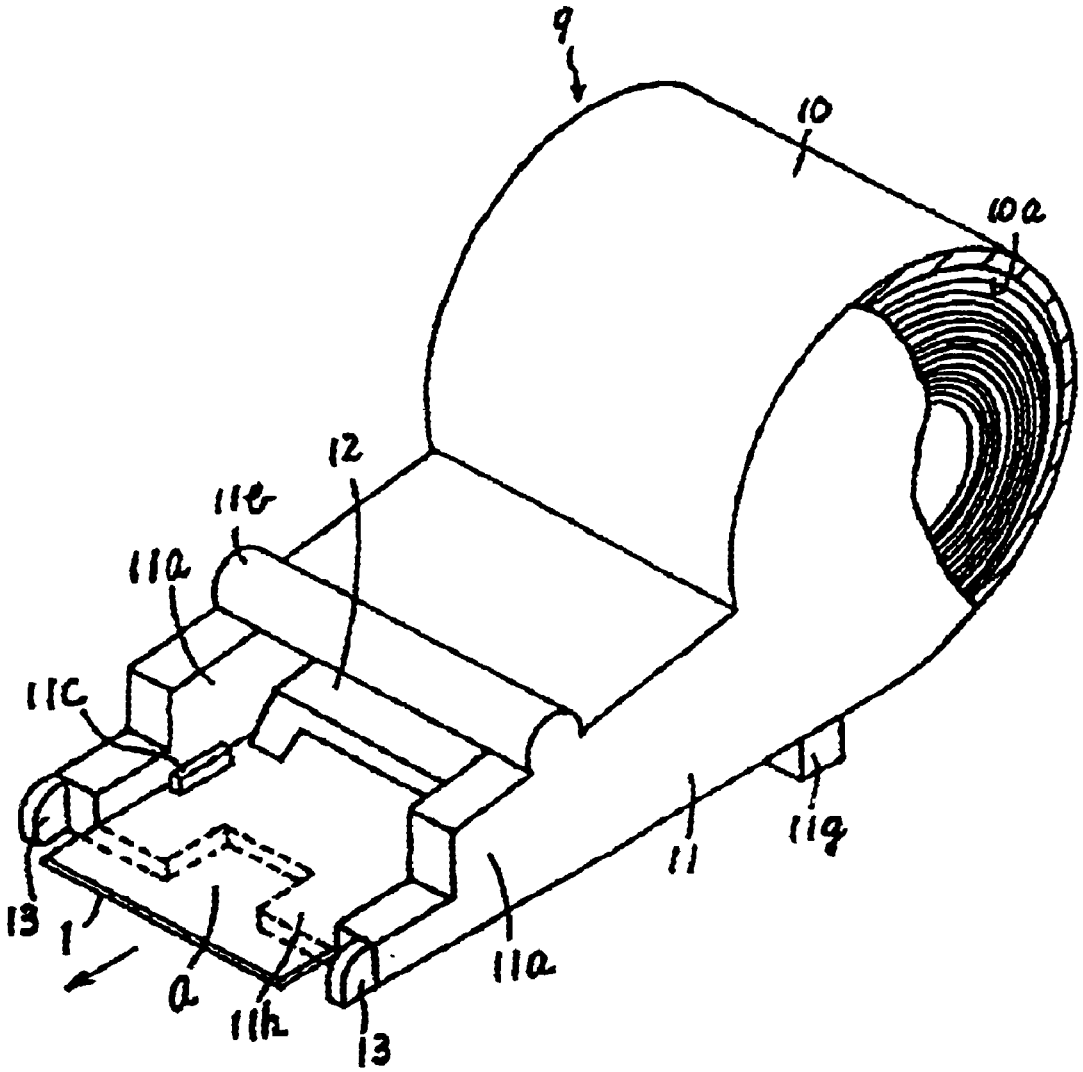
Fig. 2 PRIOR ART
FIG. 2 is a perspective view of a cartridge 9 of the prior art.
Figure 3:
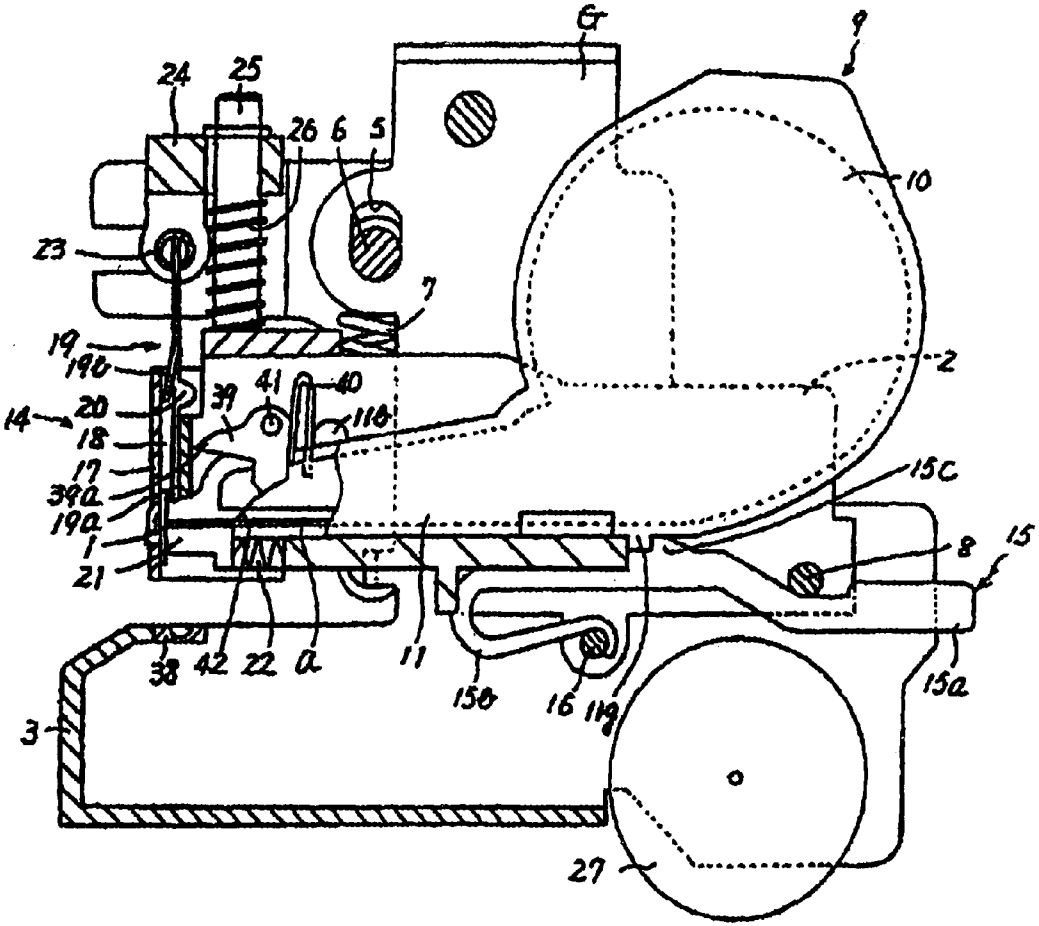
Fig. 3 PRIOR ART
FIG. 3 is a detailed cross-sectional view of the stapler in FIG. 1.
Figure 4:
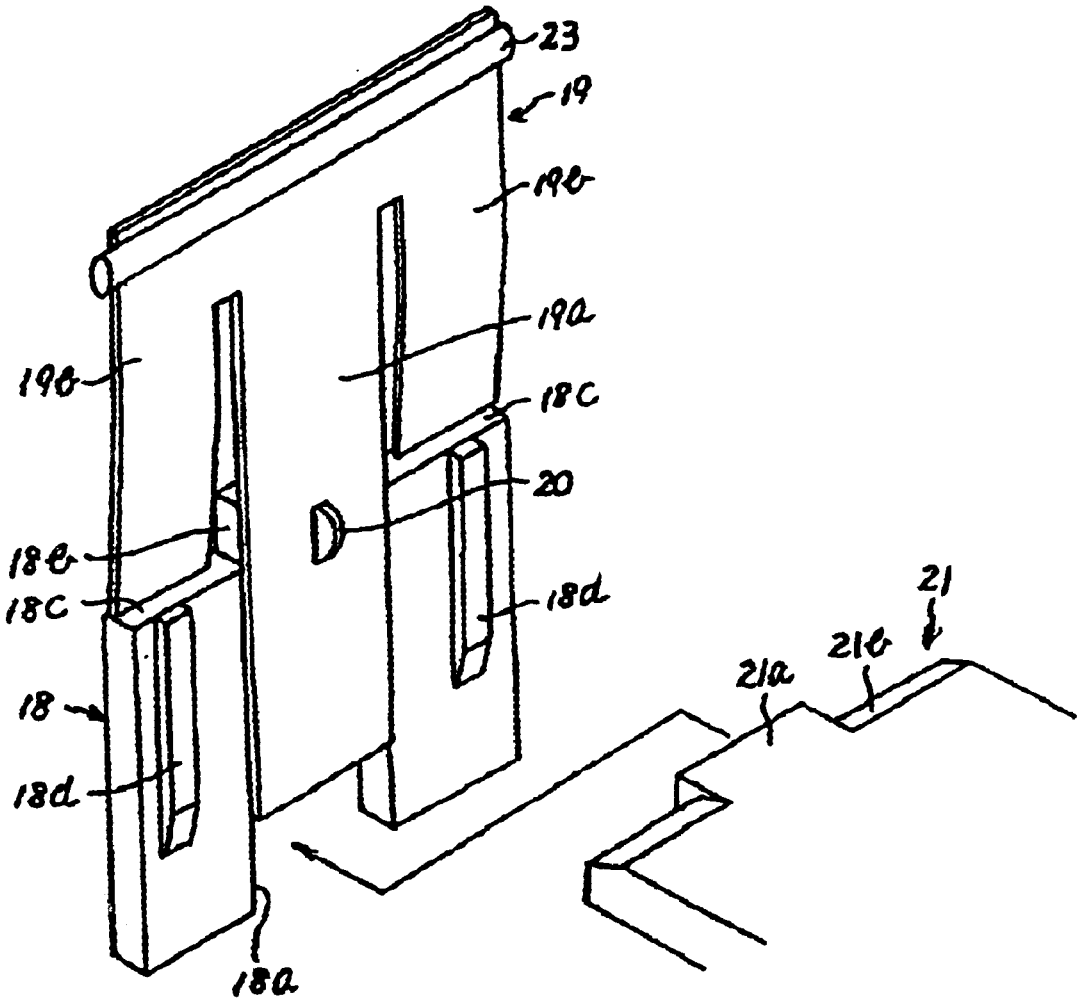
Fig. 4 PRIOR ART
FIG. 4 is an enlarged view of the staple bending unit of the prior art.
Figure 5:
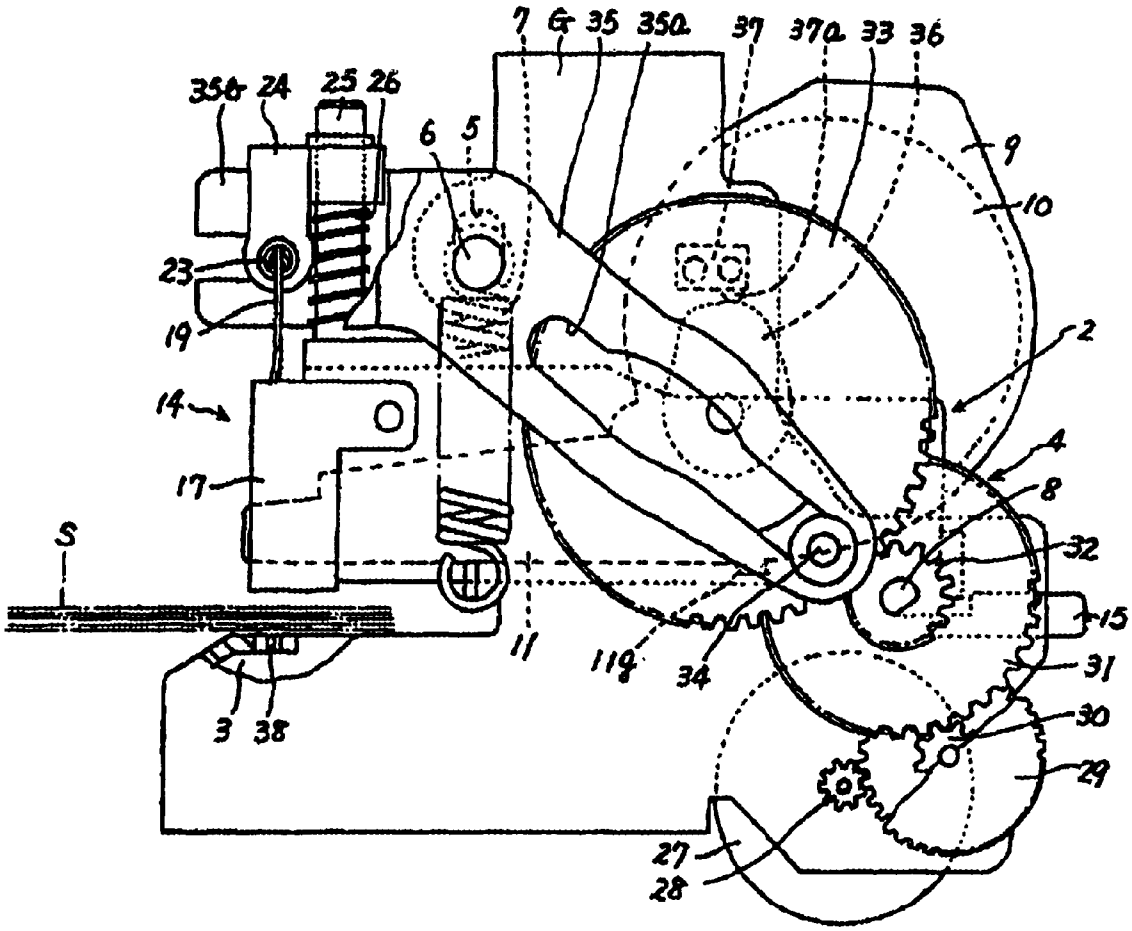
Fig. 5 PRIOR ART
FIG. 5 is a detailed external view of the stapler in FIG. 1.
Figure 6:
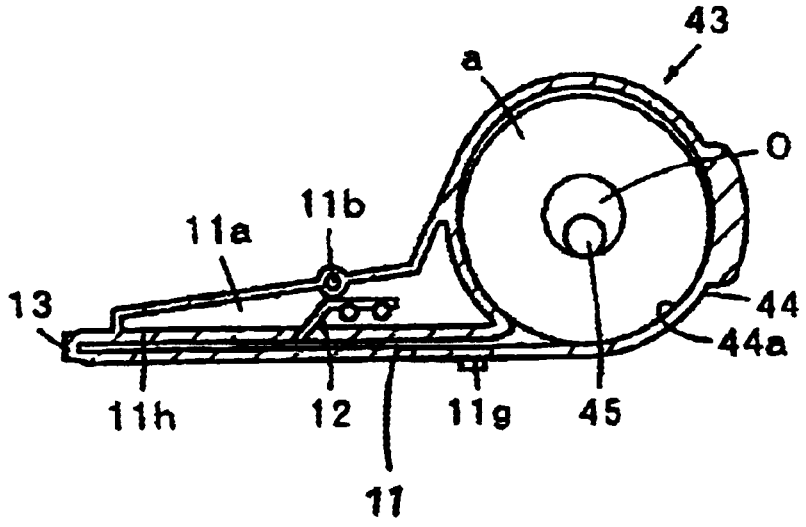
FIG. 6 is a drawing of the cartridge of a first embodiment of the present invention.

In one embodiment of the present invention shown in FIG. 6, the space forming mechanism is a shaft 45 in the housing unit 44 of the cartridge 43. In this embodiment, the shaft 45 is attached to the inner wall 44*a* of the housing unit 44 in the cartridge 43. The shaft 45 is not centered on the round housing unit 44 but is instead off-center. In other words, the shaft 45 is lower than the center line of the housing unit 44.

The degree to which the shaft 45 is off-center is equivalent to the distance between the bottom of the inner wall 44*a* of the housing unit 44 and the shaft 45 allowing the rolled sheet of staples (a) to pass through.

The center of the rolled sheet of staples (a) is inserted in the shaft 45. When the sheet of staples (a) is rolled, a round hollow cavity O is formed in the center. This hollow cavity O is inserted in the shaft 45. The shaft 45 inside the hollow cavity O of the rolled sheet of staples (a) provides support to the rolled sheet of staples (a) between the shaft 45 and the inner wall 44*a*.

When the rolled sheet of staples (a) is housed in the housing unit 44 of the cartridge 43, the sheet of staples (a) is supported between the shaft 45 and the bottom of the inner wall 44*a*. When the rolled sheet of staples (a) is supported in this way, it cannot move around inside the housing unit 44.

When the rolled sheet of staples (a) cannot move around, it cannot become unraveled. As a result, the sheet of staples (a) does not come into contact with the inner wall 44*a* of the housing unit 44, and staple feeding errors are prevented.

When staples 1 are used, the sheet of staples (a) is kept small inside the housing unit 44. When the sheet of staples (a) is kept small, the roll supported between the inner wall 44*a* and the shaft 45 is kept small. As a result, the rolled sheet of staples (a) does not move around inside the housing unit 44.

However, if the rolled sheet of staples (a) is shaken and the sheet of staples (a) begins to expand, the inner wall 44*a* and the shaft 45 limit the amount of expansion.

Because the rolled sheet of staples (a) expands concentrically, the expanded sheet of staples (a) comes into contact with the bottom of the inner wall 44*a*. When the expanded sheet of staples (a) comes into contact with the bottom of the inner wall 44*a*, further expansion downward is prevented. When the further expansion of the sheet of staples (a) is prevented on the bottom by the inner wall 44*a*, the sheet of staples (a) expands upward concentrically. However, while the sheet of staples (a) expands upward towards the inner wall 44*a*, it does not come into contact with the top of the inner wall 44*a*.

Because the sheet of staples (a) does not come into contact with the entire inner wall 44*a* of the housing unit 44 of the cartridge 43, the contact area is reduced. As a result, the amount of friction between the sheet of staples (a) and the inner wall 44*a* is reduced, and the sheet of staples (a) is able to slide along the inner wall 44*a* very easily.

Because the rolled sheet of staples (a) is kept small and the movement of the roll inside the housing unit 44 is minimized, the recoil is also reduced. As a result, the inner wall 44*a* is subjected to less force and the amount of friction between the sheet of staples (a) and the inner wall 44*a* is not increased. Because the friction is not increased, the sheet of staples (a) does not have difficulty sliding along the inner wall 44*a*. Therefore, the invention allows for reliable stapling without staple feeding errors.

The shaft 45 is off-center beneath the center line of the housing unit 44. However, the present invention is not restricted to this arrangement. The shaft 45 can be placed elsewhere so long as the degree to which the shaft 45 is off-center is equivalent to the distance between the bottom of the inner wall 44*a* of the housing unit 44 and the shaft 45 allowing the rolled sheet of staples (a) to pass through.

However, because the force of gravity lowers the sheet of staples (a), it makes sense for the shaft 45 to be located below the center line of the housing unit 44.

Figure 7:
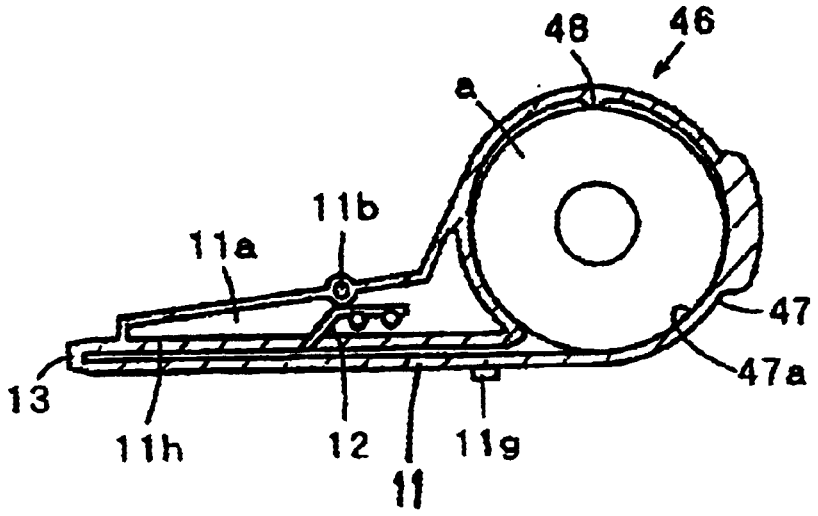
FIG. 7 is a drawing of the cartridge of a second embodiment of the present invention.

In the another of the present invention shown in FIG. 7, the outside surface of the rolled sheet of staples (a) does not come into contact with the entire inner wall of the housing unit. Here, the space forming mechanism is a protrusion 48 on the inner wall of the housing unit 47 of the cartridge 46. With the exception of the protrusion 48, this embodiment is identical to the first embodiment. A detailed explanation of the components identical to those of the first embodiment has been omitted.

In the second embodiment, the protrusion 48 is on the top of the inner wall 47*a* of the housing unit 47 in the drawing. When the rolled sheet of staples (a) is housed in the housing unit 47, the protrusion 48 on the inner wall 47*a* and the bottom of the inner wall 47*a* support the sheet of staples (a). When the rolled sheet of staples (a) is supported by the protrusion 48 on the inner wall 47*a* and the bottom of the inner wall 47*a*, the rolled sheet of staples (a) has difficulty moving around inside the housing unit 47. When the sheet of staples (a) has difficulty moving around, the roll has difficulty expanding.

Even if the rolled sheet of staples (a) moves around inside the housing unit 47 and the sheet of staples (a) expands, the expanded sheet of staples (a) comes into contact with the protrusion 48. As shown in the drawing, the sheet of staples (a) expands to make contact with the inner wall 47*a*. However, the rolled sheet of staples (a) makes contact with the protrusion 48 beneath the inner wall 47*a* and does not make contact with the area surrounding the protrusion 48. As a result, the expanded sheet of staples (a) does not make contact with the entire inner wall 47*a* of the housing unit 47.

Because the contact area between the rolled sheet of staples (a) and the inner wall 47*a* is reduced, the amount of friction is also reduced. As a result, the sheet of staples (a) is able to slide along the inner wall 47*a* of the housing unit 47 very easily, and feed errors are prevented.

In the second embodiment, the protrusion 48 is formed on the inner wall 47*a* of the housing unit 47 near the top of the drawing. However, it can be placed anywhere on the inner wall 47 so long as the placement reduces the contact area between the sheet of staples (a) and the inner wall 47*a* of the housing unit 47.

Figure 8:
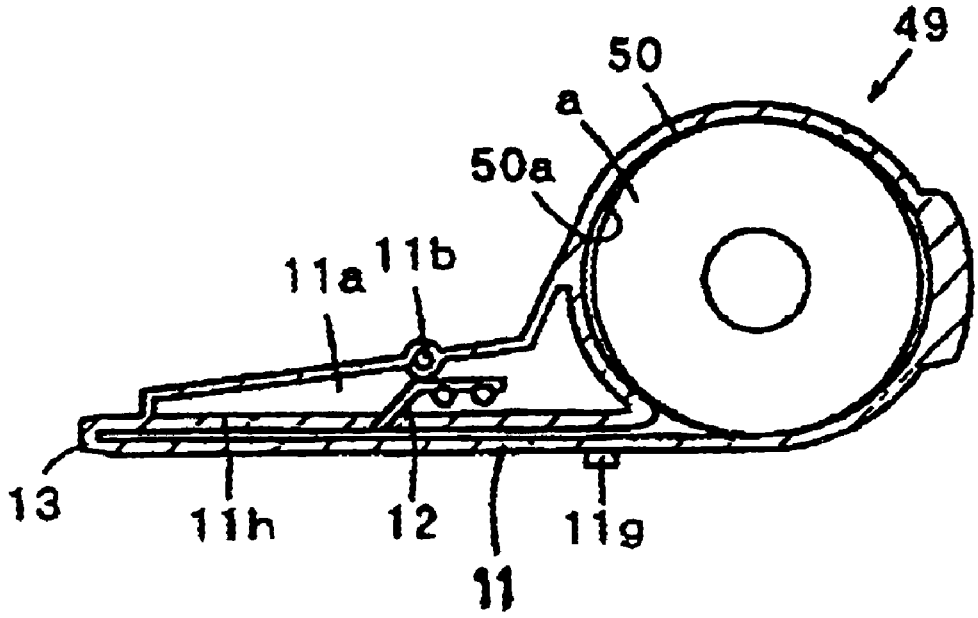
FIG. 8 is a drawing of the cartridge of a third embodiment of the present invention.

In a third embodiment of the present invention shown in FIG. 8, the space forming mechanism is an oval shaped housing unit 50 inside the cartridge 49. With the exception of the oval-shaped housing unit 50, the embodiment is identical to the first embodiment. A detailed explanation of the components identical to those of the first embodiment has been omitted.

In the third embodiment, the housing unit 50 inside the cartridge 49 is oval shaped widthwise and the inner wall 50*a* is oval shape. A rolled sheet of staples (a) is housed inside the oval-shaped housing unit 50.

As shown in FIG. 8, when a rolled sheet of staples (a) is housed inside the oval-shaped housing unit 50, the upper end and the lower end of the oval-shaped housing unit 50 support the sheet of staples (a). Because the sheet of staples (a) is supported on these two places, the rolled sheet of staples (a) has difficulty moving around inside the housing unit 50. When the sheet of staples (a) has difficulty moving around inside the housing unit 50, the rolled sheet of staples (a) has difficulty expanding.

Even if the rolled sheet of staples (a) moves around inside the housing unit 50 and the sheet of staples (a) expands, the sheet of staples (a) expands concentrically. Because the rolled sheet of staples (a) is supported along the short axis of the oval-shaped housing unit 50, it cannot make contact with the housing unit 50 along the long axis. As a result, the expanded sheet of staples (a) does not make contact with the entire inner wall 50*a* of the housing unit 50.

Because the contact area between the rolled sheet of staples (a) and the inner wall 50*a* is reduced, the amount of friction is also reduced. As a result, the sheet of staples (a) is able to slide along the inner wall 50*a* of the housing unit 50 very easily, and feed errors are prevented.

In the third embodiment, the housing unit 50 is oval shaped. However, the rolled sheet of staples (a) can be supported at many points on the inside of the housing unit. In other words, the inner wall 50*a* of the housing unit 50 can have a different shape in order to provide support to the rolled sheet of staples (a) at many different points. This would still reduce the contact area between the rolled sheet of staples (a) and the inner wall 50*a* of the housing unit 50. As a result, the housing unit 50 can be shaped like an oval, but also like a rectangle or triangle.

In the first, second and third embodiments, the space forming mechanism prevents the outside surface of the rolled sheet of staples housed inside the housing unit from coming into contact with the inside surface of the housing unit. As a result, the rolled sheet of staples cannot make contact with the entire inside surface of the housing unit. The reduction in the contact area between the rolled sheet of staples and the inside surface of the housing unit reduces the amount of friction and recoiling force. Therefore, the sheet of staples is able to slide along the inner wall of the housing unit very easily, and feed errors are prevented.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed:

1. A cartridge housing a rolled sheet of staples, the cartridge comprising:

a rolled sheet of staples;

a housing unit for housing the rolled sheet of staples;

a guide unit for supporting the sheet of staples drawn from an opening in the housing unit; and a space forming mechanism for forming a space between the rolled sheet of staples housed in the housing unit and an inner wall of the housing unit;

wherein the sheet of staples forms a hollow cavity in a center of the rolled sheet of staples and the space forming mechanism is a shaft off-center from a center line of the housing unit and extending at least partially through the hollow cavity in the sheet of staples.

2. The cartridge of claim 1, wherein the shaft is off-center beneath the center line of the housing unit.

* * * * *